US009433313B2

(12) United States Patent
Lenz, Jr.

(10) Patent No.: US 9,433,313 B2
(45) Date of Patent: Sep. 6, 2016

(54) FLEXIBLE MAILBOX SUPPORT WITH DETACHABLE SWING ARM AND REPLACABLE OUTER SLEEVE

(76) Inventor: Arthur W. Lenz, Jr., Papillion, NE (US)

( * ) Notice: Subject to any disclaimer, the term of this patent is extended or adjusted under 35 U.S.C. 154(b) by 44 days.

(21) Appl. No.: 13/507,718

(22) Filed: Jul. 23, 2012

(65) Prior Publication Data

US 2014/0021311 A1 Jan. 23, 2014

Related U.S. Application Data

(60) Provisional application No. 61/572,943, filed on Jul. 25, 2011.

(51) Int. Cl.
*A47G 29/122* (2006.01)

(52) U.S. Cl.
CPC ..... *A47G 29/1216* (2013.01)

(58) Field of Classification Search
CPC ..... A47G 29/1216; E01F 9/0118
USPC ..... 232/39; D99/29–33; 248/548, 900, 131, 248/145, 372.1, 160, 415, 417, 545, 125.8, 248/148, 156, 218.4, 219.2, 354.2, 530, 248/534; 40/606.06, 607.05, 607.06, 40/607.09, 607.04, 608; 403/223, 229
See application file for complete search history.

(56) References Cited

U.S. PATENT DOCUMENTS 1,273,696 A * 7/1918 Vanhoof ..... A47G 29/1216 248/145
1,726,817 A * 9/1929 Franklin ..... E01F 9/017 116/63 R
1,753,506 A * 4/1930 Florine ..... A47G 29/1216 116/173
1,828,892 A * 10/1931 Felton ..... 116/173
2,145,782 A * 1/1939 Townsend ..... 248/145
2,149,050 A * 2/1939 Hajicck ..... A47G 29/1216 232/39
2,165,704 A * 7/1939 Hood ..... E01F 9/017 256/1
2,522,983 A * 9/1950 Bergstrom ..... A47G 29/1216 248/145
2,646,950 A * 7/1953 Nelson ..... G10K 11/006 116/227
2,949,324 A * 8/1960 Birge et al. ..... 403/229
3,658,284 A * 4/1972 Haasl ..... A47G 29/1216 16/76
3,899,150 A * 8/1975 Racquet ..... A47G 29/1216 16/76
4,270,873 A * 6/1981 Laehy ..... A63C 19/062 256/1
4,368,842 A * 1/1983 DeLange, III ..... 232/17
4,491,438 A * 1/1985 Berutti ..... A63C 19/062 40/608
4,498,657 A * 2/1985 Werner ..... F16M 13/00 248/469
4,792,088 A * 12/1988 Bonnell ..... A47G 29/1216 232/17
4,995,576 A * 2/1991 Kieswetter ..... A47G 29/1216 248/145
5,029,783 A * 7/1991 Alvarez ..... 248/146
5,042,716 A * 8/1991 Robbins ..... A47G 29/1216 232/39
5,207,175 A * 5/1993 Andonian ..... E01F 9/0175 116/209
5,207,377 A * 5/1993 Brecht ..... A47G 29/1216 232/17
5,215,283 A * 6/1993 Gould ..... 248/145

(Continued)

*Primary Examiner* — Jonathan Liu
*Assistant Examiner* — Guang H Guan
(74) *Attorney, Agent, or Firm* — Philip J. Lee

(57) ABSTRACT

A flexible mailbox support is assembled by pivotable attachment of a mailbox support arm to a post having two rigid sections separated by a flexible middle section and coverable by a replaceable sleeve, the connection between the support arm and the post uses a single bolt inserted through and joining a flat surface on the arm to a flat surface on the top of the post, formed to be detachable with force, the parallel surfaces being set at an angle of less than 90 degrees from the post and a spring is compressed by the bolt head to adjustably bias the surfaces against one another while allowing the arm to pivot about the axis of the bolt, with a cage providing protection for the mailbox.

2 Claims, 4 Drawing Sheets

(56) References Cited

U.S. PATENT DOCUMENTS 5,713,514 A * 2/1998 Eck ..... 232/39
5,803,353 A * 9/1998 Fisher ..... A47G 29/1216 232/39
5,848,584 A * 12/1998 Brog ..... A47J 33/00 126/25 A
6,223,982 B1 * 5/2001 Dunn ..... 232/39
6,237,268 B1 * 5/2001 Levin ..... G09F 15/0056 248/160
6,430,855 B1 * 8/2002 Gertz ..... G09F 7/18 248/548
6,810,890 B2 * 11/2004 Lin ..... A45B 17/00 135/16
6,969,212 B1 * 11/2005 Richens ..... E01F 9/0175 404/10
7,032,811 B1 * 4/2006 Paulic et al. ..... 232/39
7,108,445 B2 * 9/2006 Henriques ..... 403/202
7,353,985 B1 * 4/2008 Weatherholt, II ..... 232/39
7,510,162 B2 * 3/2009 Lackey ..... A47G 29/1203 232/39
7,832,695 B2 * 11/2010 Ebel ..... E01F 9/0175 248/156
7,997,545 B2 * 8/2011 Holland ..... 248/145
2010/0237143 A1 * 9/2010 LaBrecque, Jr. .. A47G 29/1216 232/39
2014/0021311 A1 * 1/2014 Lenz, Jr. ..... A47G 29/1216 248/156

* cited by examiner

FLEXIBLE MAILBOX SUPPORT WITH DETACHABLE SWING ARM AND REPLACABLE OUTER SLEEVE

CROSS REFERENCE TO RELATED PROVISIONAL APPLICATION

This application claims the benefit of U.S. Provisional Application No. 61/572,943 filed Jul. 25, 2011.

BACKGROUND OF THE INVENTION

A. Field of Invention

The present invention relates generally to devices used to support mailboxes or other roadside receptacles, and more particularly to an assembly of a flexible mailbox post and arm.

B. Description of Related Art

Conventional mailboxes and other roadside receptacles such as newspaper tubes are supported on rigid posts formed of a variety of materials, such as, steel or wood, with a laterally extending arm to position the mailbox close to the roadside for the convenience of delivery while placing the post at a safer distance from the road. Due to the usual placement of mailboxes in close proximity to roads, rigid mailbox posts are susceptible to being bent or broken on impact, frequently by motor vehicles. One solution to the problems caused by impacts is to build a stronger structure to house the mailbox, using metal, wood or masonry materials to form a structure that would suffer minimal damage when struck by a vehicle. This approach transfers the burden of damage from the mailbox to the vehicle, which causes a hazard to the human occupants of the vehicle and results in damage to the vehicle, which is frequently more valuable than the mailbox and supporting structure. The opposite approach is to make the mailbox relatively light and weak so as to allow it to break away easily on impact, which usually results in the destruction of the mailbox. What is needed is a means of supporting the usual residential mailbox that is durable and does not pose an unreasonable hazard for vehicles that might impact the mailbox.

It would therefore be desirable to provide a mailbox support that is economical to manufacture and convenient for use with normal residential mailboxes and that reduces or prevents damage to the mailbox and a vehicle impacting the mailbox.

SUMMARY OF THE INVENTION

The device of the present invention is a flexible mailbox support comprising a mailbox support arm and a post having two rigid sections separated by a flexible middle section. The bottom post section is conveniently sized and shaped for ease of installation on site and the top post section is sized and shaped to secure the mailbox support arm such that the arm is able to rotate in response to an impact while returning to its original position when the impact ceases. The connection between the support arm and the top of the post comprises a single bolt inserted through and joining two flat and parallel surfaces that are set at an angle of less than 90 degrees from the post. A spring is compressed by and between the bolt head or nut and one of the surfaces to bias the surfaces against one another while allowing the arm to pivot about the axis of the bolt. The flat surface connected to the post is secured to the top of an insert that is shaped and sized to be inserted into the top of the post and to be securely attached thereto while being detachable from the post on impact The mailbox support arm is shaped and sized to readily accommodate installation of a conventional mailbox and to position the mailbox laterally extended outward from the post and below the opposing slanted surfaces. Positioning the weight of the mailbox and arm lower than the slanted surfaces causes the force of gravity to urge the arm into a position in line with the direction of the slant of the opposing surfaces. The top and bottom post sections are formed of metal, plastic, or other suitable material as may be desired and may incorporate other features commonly used for mounting mailboxes, including use without the mailbox support arm. The flexible middle post section is formed of a coiled spring or other flexible and resilient material, and is securely affixed in linear fashion between the top and bottom post sections, such that the constructed support resembles the usual shape of a conventional mailbox post. An upper portion of the flexible middle section is secured within and supported by the top post section and a lower portion of the flexible middle section is secured within and supported by the bottom post section, and a middle portion of the flexible middle section is open and not supported by either the top or bottom post section, which allows it to flex. The material and characteristics of the middle post section are chosen to have sufficient flexibility so that the support will bend upon impact sufficiently forceful as to otherwise cause damage to either the mailbox, the support or the impacting vehicle and with sufficient resilience to return to the original position after removal or cessation of the impacting force. The post sections are adapted to secure the flexible section in a variety of lengths to allow variation and adjustment of the flexibility of the support post by adjustment of the length of the middle portion of the flexible section that is not supported by being within the top or bottom post sections. In this manner, the overall flexibility of the post can be varied as may be desired to protect children, for example.

The mailbox support arm is able to move laterally and the post section is able to bend from the vertical original position and both the mailbox carrying arm and the post will return their original positions. A removable cover sleeve is provided to protect the post from exposure to the elements and may be colored or decorated as desired. The cover sleeve is generally cylindrical and sized to fix over the post and is fabricated of an appropriately flexible and resilient material. A protective cage is provided to surround and protect the mailbox and is secured to the support arm.

The principle aim of the present invention is to provide a new and improved device that meets the foregoing requirements and is economical, convenient and safe to assemble, install and use.

Other objects and advantages of the invention will become apparent from the Description of the Preferred Embodiments and the Drawings and will be in part pointed out in more detail hereinafter.

The invention consists in the features of construction, combination of elements and arrangement of parts exemplified in the construction hereinafter described and the scope of the invention will be indicated in the appended claims.

DESCRIPTION OF THE PREFERRED EMBODIMENT(S)

Figure 1:
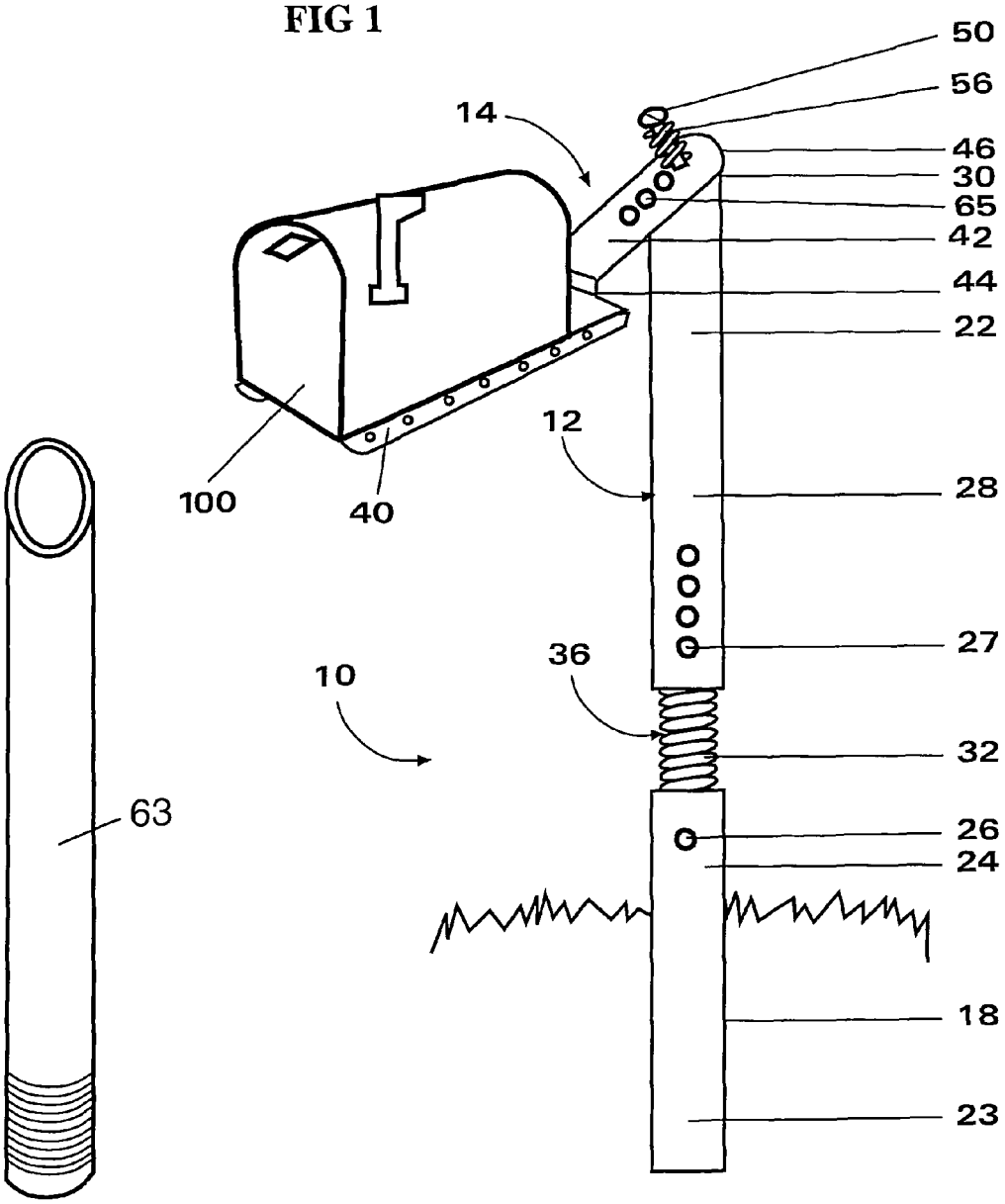
FIG. 1 is a perspective view of an assembled device according to the present invention installed in ground and with mailbox attached and cover sleeve uninstalled.
Figure 2:
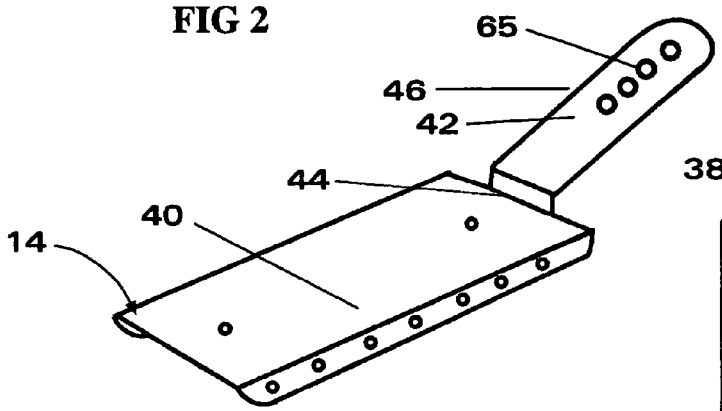
FIG. 2 is a perspective view of the arm of a device according to the present invention, being unattached to the post section and without a mailbox attached.
Figure 3:
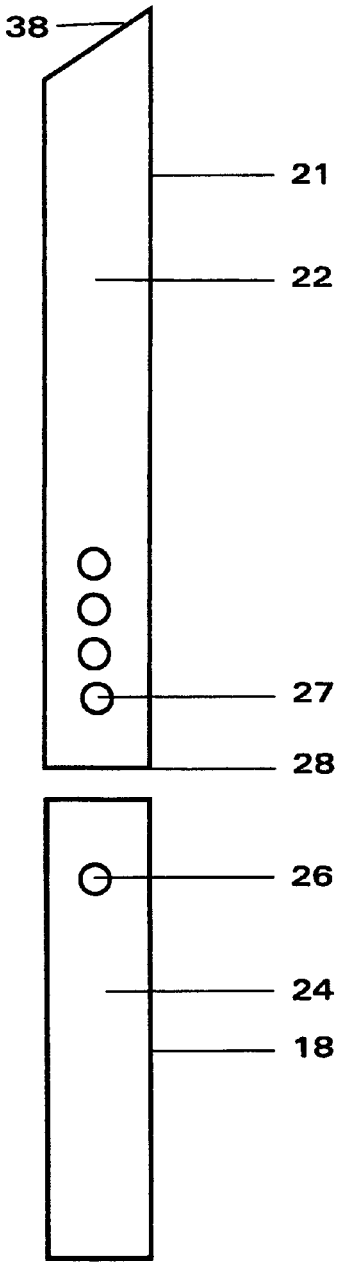
FIG. 3 is a side view of the unassembled sections of a post for a device according to the present invention.
Figure 5:
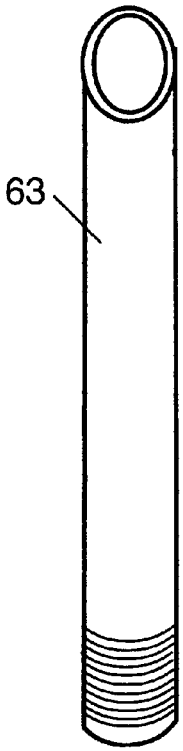
FIG. 5 is a side perspective view of a cover sleeve according to the present invention.
Figure 5:
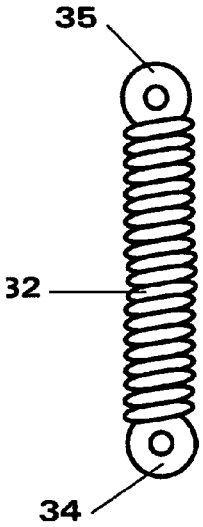
Figure 4:
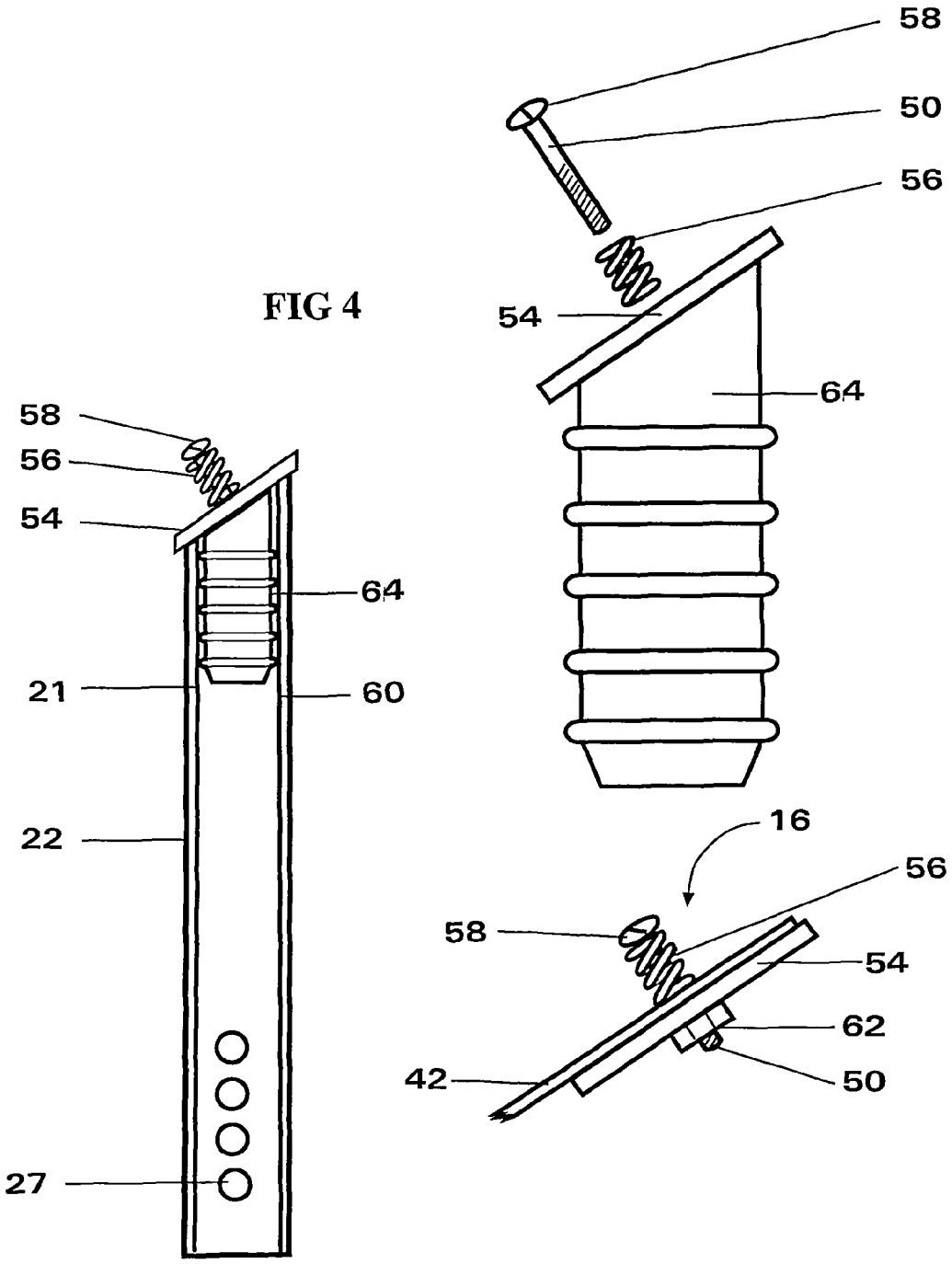
FIG. 4 is a side view of the partially assembled components of the part of a device according to the present invention, showing the attachment of the support arm to the post thereof.
Figure 6:
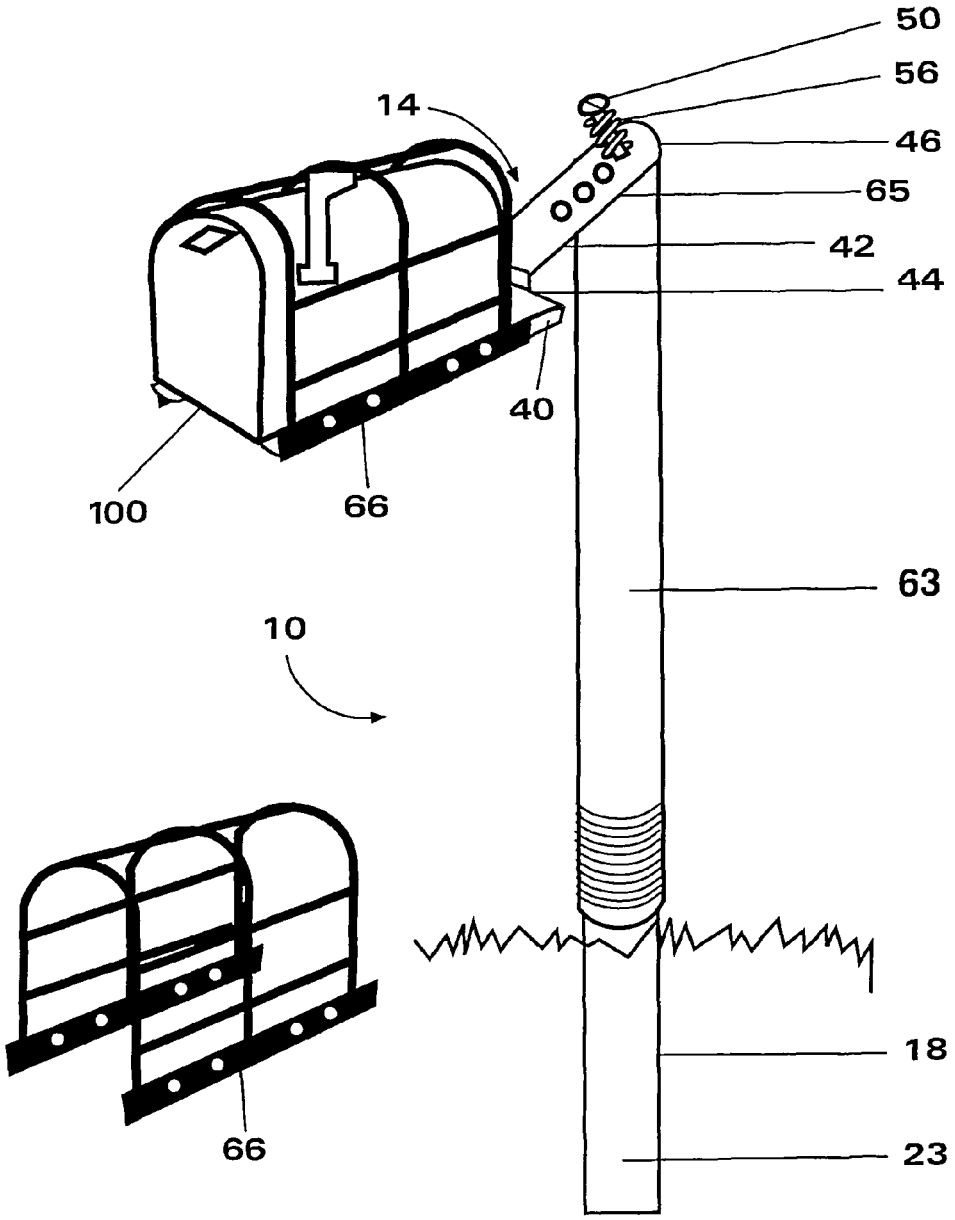
FIG. 6 is a perspective view of an assembled device according to the present invention installed in ground and with mailbox attached and with cover sleeve installed.

With reference to the Drawings wherein like numerals represent like parts throughout the Figures, an assembly of the present invention for supporting a mailbox is generally designated by numeral 10 in FIG. 1. An exemplar of a common mailbox is shown in FIG. 1 and designated by the numeral 100 as an example only. The present invention comprises a post assembly 12, an arm assembly 14, a cage protector 66, a post cover sleeve 63 and a connecting device 16 for attaching the arm 14 to the post 12.

Post assembly 12 comprises a lower section 18 formed of a tubular section of pipe or other material being straight, cylindrical and having a central open core. An upper section 22 of the post assembly 12 is similarly formed of a length of tubing similar in size as the lower section 18 with a central open core 21. Lower post section 18 comprises an installation end 23 suitable for installation into the ground and an opposite, spring securing end 24, in which, in the illustrated preferred embodiment, diametrically opposed holes 26 are formed. Upper post section comprises a lower, spring securing end 28 with a series of vertically separated, diametrically opposing holes 27 and an upper, arm attaching end 30. A helical spring 32 has axially oriented loops 34 and 35 at either end, and has an outside diameter equal to or slightly less than the inner diameter of the spring securing ends 24 and 28. Post assembly 12 is assembled by inserting an end of spring 32 into each spring securing end 24 and 28 and securing the spring 32 therein by means of a bolt inserted through lower section holes 26 and spring loop 34 at one end and another bolt inserted through upper section holes 27 and spring loop 35 at the other end. Holes 26 and 27 are displaced from the ends of post sections 18 and 22 sufficiently to provide adequate and adjustable length support for spring 32 and leaving only a relatively short middle spring section 36 open, being not within either post section 18 or 22, such that post assembly 12 is able to resiliently bend by the distortion of spring open section 36. Upper post section arm attaching end 30 is formed with a slanting section 38 formed by cutting across the top of post section 30 at an angle other than 90 degrees from the axis of top post section 22. Alternatively, an adapter can be formed to be inserted into the top end 30 of upper post section 18 to provide the slanting section 38.

It will be anticipated that alternative materials and details of construction can be used in assembling post assembly 12, including the use of types of resilient and flexible material such as rubber or plastic pieces as substitutes for spring 32. The essential requirements for the material and construction of the middle post section that consists of spring 32 in the preferred embodiment are that the section be strong enough to support the arm 14 and attached mailbox in 10 a proper position, while being flexible enough to bend under impact and resilient enough to regain its former shape after impact.

Arm 14 comprises a mailbox mounting section 40 that is generally flat and rectangular in at least one aspect and that is connected to a flat and linear angled section 42 by means of an angled joint 44 such that angled section 42 is angled upward relative to horizontal mailbox mounting section 40. The end of angled section 42 opposite from joint 44 comprises a flat end 46 in which a series of holes 65 is formed in a central position, equally distant from the sides of angled section 42 and at varying distance from the end 46 of section 42 to allow adjustment of the mailbox position relative to the post. The connecting device 16 comprises the engagement of angled section end 46 with a flat surface 54 that is angled relative to the post assembly 12 and is secured to a plug insert member 64 having a generally cylindrical body comprising a series of annular ridges that is sized to fit within the slanted section 38 of top post section 22. Plug member 64 is formed of a deformable material such as plastic or rubber to allow an interference fit within the upper post 22 such that the plug 64 is securely attached to upper post 22 but can be detached therefrom. The retentive force of plug insert 64 is weak enough to allow detachment of arm 14 from post section 22 upon suffering a separating force of an impact of sufficient force that would otherwise damage a vehicle or other object impacting the arm 14. Flat surface 54 is thus slanted relative to the axis of post assembly 12 and comprises a centrally located bolt-receiving hole. Arm flat end 46 is attached to upper post section end 30 by means of a bolt 50 inserted through a selected one of angled section holes 65 and the bolt hole formed in surface 54.

A helical spring 56 is retained and between bolt head 58 and arm flat end 46 such that threading bolt 50 into screw threads in a nut 62 on the opposite side of surface 54 increasingly compresses spring 56 which biases arm flat end 46 against slanted flat surface 54. The force of the engagement of arm lever section end 46 against surface 54 is adjustable by adjustment of bolt 50 such that the arm section 14 is allowed to pivot about bolt 50 and thus rotate relative to the axis of post 12 on impact. The force of gravity due to the weight of arm 14 causes arm 14 to remain in a resting position in the direction of the slant of surface 54, when not displaced therefrom by impact. After impact on the mailbox causes arm 14 to rotate from its resting position and the displacing force of impact has been discontinued, the force of gravity will cause arm 14 to resume its resting position. Adjustment of the force biasing arm flat end 46 against surface 54 is accomplished by rotation of bolt 50 relative to nut 62, thereby varying the compression of spring 56. It will be anticipated that alternatives to spring 56 can be substituted without departing from the invention so long as such substitutes are formed of compressible and resilient material shaped to accept bolt 50.

A cover sleeve 63 is cylindrical in general shape and is sized to slidingly fit over the post assembly 12 to protect the post assembly 12 from the elements and to provide decoration opportunity as well as safety from unintended pinching by the spring 32. Cover sleeve 63 is preferably formed of a resilient plastic or rubber to allow post assembly 12 to distort on impact as desired.

A cage 66 is provided in a shape similar to but slightly larger than mailbox 100 and comprises means for securing cage 66 to the flat arm section 40 in a protective position over mailbox 100.

While preferred embodiments of the foregoing invention have been set forth for purposes of illustration, the foregoing description should not be deemed a limitation of the invention herein. Accordingly, various modifications, adaptations and alternatives may occur to one skilled in the art without departing from the spirit and the scope of the present invention. It is specifically anticipated a variety of materials could be suitable for use in constructing device 10 without departing from the spirit of this invention, including use of flexible and resilient plastic material in place of the illustrated spring may accomplish the same result. It is further anticipated that other uses and combinations of some or all of the components of assembly 10 will be found to be useful.

What is claimed is:

1. A mailbox supporting device comprising:

a flexible vertical post having an upper rigid section, a lower rigid section, and a flexible middle section linearly attached between and separating the upper and lower rigid sections, the upper rigid section being tubular and including a top end and a flexible middle section receiving end, the flexible middle section being formed of a helical spring with a vertically looped end, the flexible middle section receiving end of the upper rigid section including a central bore with a diameter sufficient to receive the vertically looped end of the flexible middle section, and the flexible middle section receiving end of the upper rigid section further including a plurality of vertically separated holes for securing the vertically looped end of the flexible middle section within the upper rigid section by a bolt inserted through the vertically looped end of the flexible middle section and any one of the plurality of vertically separated holes of the flexible middle section receiving end of the upper rigid section such that a length of the flexible middle section within the upper rigid section is adjustable;

a removable cylindrical sleeve installed over and covering the upper rigid section of the flexible vertical post and the flexible middle section of the flexible vertical post;

a laterally extending arm including a first flat surface, a second flat surface, and an intermediary section secured between the first and second flat surfaces, the first flat surface having a plurality of linearly arrayed holes extending therethrough, the second flat surface being perpendicular to a vertical axis of the flexible vertical post and configured to mount a mailbox thereon, and the intermediary section extending at a first angle with respect to the first flat surface;

a detachable plug being inserted into the top end of the upper rigid section of the flexible vertical post and removably retained therein by friction; and a joining device attached between the laterally extending arm and the flexible vertical post, the joining device having a flat surface and a pivot securing the first flat surface of the laterally extending arm to the flat surface of the joining device, the flat surface of the joining device being secured to the detachable plug and slanted at a second angle with respect to the vertical axis of the flexible vertical post, the second angle being supplementary to the first angle, the pivot of the joining device including a bolt projecting perpendicularly upward with respect to the flat surface of the joining device, the bolt of the pivot further extending through a central hole in the flat surface of the joining device and any one of the plurality of linearly arrayed holes of the first flat surface of the laterally extending arm such that a position of the second flat surface of the laterally extending arm is adjustable vertically and laterally with respect to the flexible vertical post, and the joining device further including a compressible and resilient member compressed between the bolt of the pivot and the first flat surface of the laterally extending arm and biasing the first flat surface of the laterally extending arm against the flat surface of the joining device.

2. The mailbox supporting device of claim 1, further comprising a cage secured to the second flat surface of the laterally extending arm for protecting the mailbox mounted thereon.

* * * * *